United States Patent [19]

Albert et al.

[11] 4,382,321

[45] May 10, 1983

[54] MACHINE FOR FRAYING WOVEN FABRICS

[75] Inventors: Marcel Albert; Joseph Fortin; Robert Parenteau, all of Les Herbiers, France

[73] Assignee: Ets Albert S.A., Les Herbiers, France

[21] Appl. No.: 214,734

[22] Filed: Dec. 9, 1980

[30] Foreign Application Priority Data

Dec. 13, 1979 [FR] France ..... 79 30903

[51] Int. Cl.[3] ..... D04D 5/00; D06H 7/00

[52] U.S. Cl. ..... 28/145

[58] Field of Search ..... 28/144, 145, 146; 139/291 C

[56] References Cited

U.S. PATENT DOCUMENTS 222,273 12/1879 Havers et al. ..... 28/144

661,605 11/1900 Hafter ..... 28/146

3,032,457 5/1962 Sarkissian ..... 28/145 X

*Primary Examiner*—Robert Mackey

*Attorney, Agent, or Firm*—Fleit, Jacobson & Cohn

[57] ABSTRACT

The present invention relates to a machine for fraying woven fabrics, comprising a table adapted to receive the fabric; a drive device adapted to advance the fabric over the table; an engaging device with reciprocating vertical displacement adapted to pass the yarns of the fabric which are parallel to the direction of advance, through an opening in the table; a cutting tool disposed beneath the table to cut the yarns having passed through said opening, so as to obtain a drawn fabric having only yarns perpendicular to the direction of advance; and a fraying knife disposed above the table and behind the engaging device, with respect to the direction of advance, to cut the yarns of the drawn fabric and fray the fabric.

6 Claims, 6 Drawing Figures

MACHINE FOR FRAYING WOVEN FABRICS

The present invention relates to the textile and clothing industries and, more particularly, to a machine for fraying woven fabrics.

The fringed fabrics used in the manufacture of clothes or in the decoration of different articles of clothing have heretofore been made essentially by hand, in two different ways. In fact, these fabrics were frayed either by tearing the yarns one by one by hand, or with the aid of an apparatus similar to a brush able to tear one or more yarns at a time over the whole width of the fabric. In either case, the fraying work is tedious, long and unpleasant and high rates of production are not attained.

It is an object of the present invention to avoid these drawbacks by proposing a machine for rapidly fraying woven fabrics.

Thus, instead of the 10 to 12 meters per hour of finished products per person obtained by hand, the machine of the invention produces 50 meters of frayed fabric per hour in the case of a single fringe on one piece of fabric and 100 meters per hour of frayed fabric in the case of a fringe on two pieces of fabric at a time.

The machine of the invention comprises a table adapted to receive the fabric; a drive device adapted to advance the fabric over the table; an engaging device with reciprocal vertical movement adapted to pass the yarns of the fabric parallel to the direction of advance, through an opening in the table; a cutting tool disposed beneath the table to cut the yarns which have passed through said opening, so as to obtain a drawn fabric having only yarns perpendicular to the direction of advance; and a fraying knife disposed above the table and behind the engaging device, with respect to the direction of advance, to cut the yarns of the drawn fabric and fray the fabric.

The invention will be more readily understood on reading the following description with reference to the accompanying drawings, in which.

Figure 1:
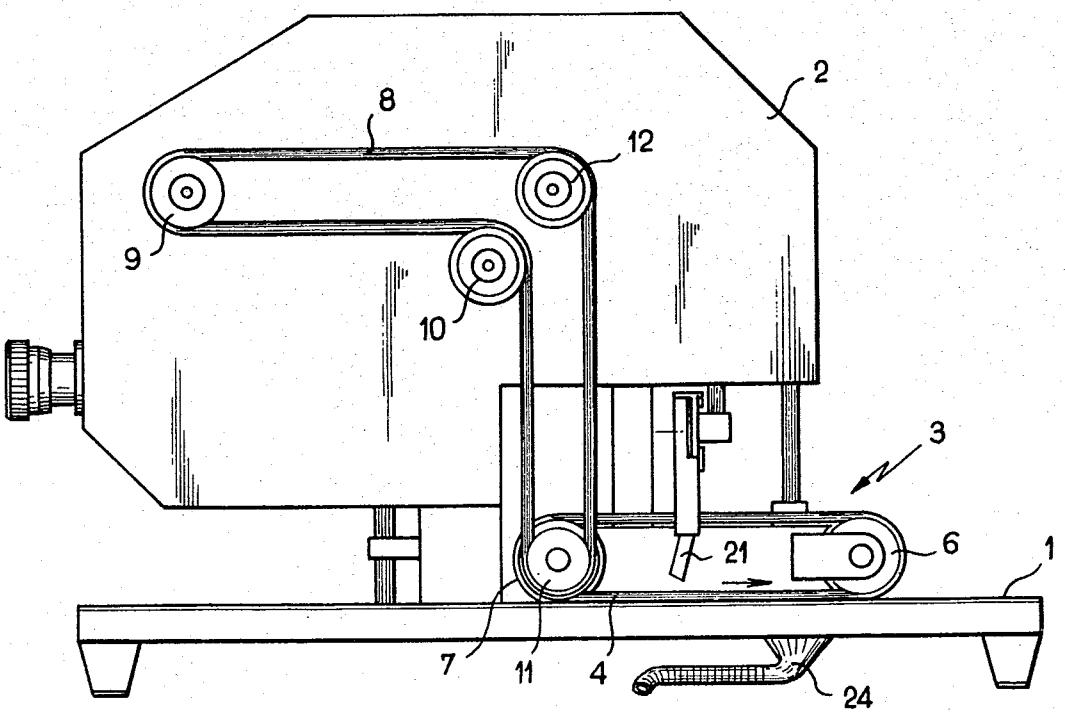
FIG. 1 is a view in elevation of a machine according to the invention.

Referring now to the drawings, the machine shown therein comprises a work table 1 adapted to receive a piece of fabric to be frayed and a frame 2 in swan neck form supporting certain members of the machine.

Figure 3:
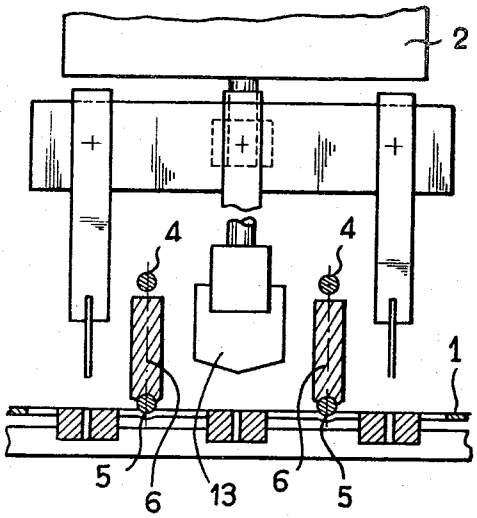
FIG. 3 is a view in section taken along line III—III of FIG. 2.

The fabric is taken along over the table 1 by means of a drive device 3 comprising two parallel belts 4 applying the fabric on the table 1. Two notches 5 are provided on the top of the table 1 parallel to the belts 4 to ensure the tension of the fabric therebetween (FIG. 3). The belts 4 of the device 3 pass around front pulleys 6 and rear pulleys 7 and are continuously driven by a motor (not shown), a transmission belt 8 and guide pulleys 9, 10, 11, 12 (FIG. 1).

The machine further comprises an engaging device constituted by a V-shaped punch 13, with reciprocating vertical movement, disposed above the table 1 and between the two drive belts 4. This engaging device is adapted to pass the yarns of the fabric which are parallel to the direction of advance, through an opening 14 in the table 1.

Figure 5:
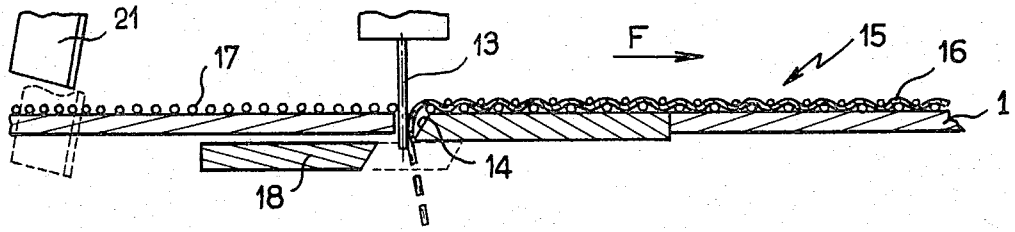
FIG. 5 illustrates the functioning of the engaging device and the cutting member of the machine of FIG. 1.

FIG. 5 schematically shows a piece of fabric 15 moved over the table 1 in the direction of advance shown by arrow F. The fabric 15 comprises warp yarns such as 16, parallel to the direction of advance, and weft yarns such as 17, perpendicular to the direction of advance. The warp yarns 16 which are located in the zone corresponding to the transverse width of the punch 13 are engaged through the opening 14 and pass beneath the table 1 where they are then cut by a cutting tool 18 disposed beneath the table 1.

Figure 2:
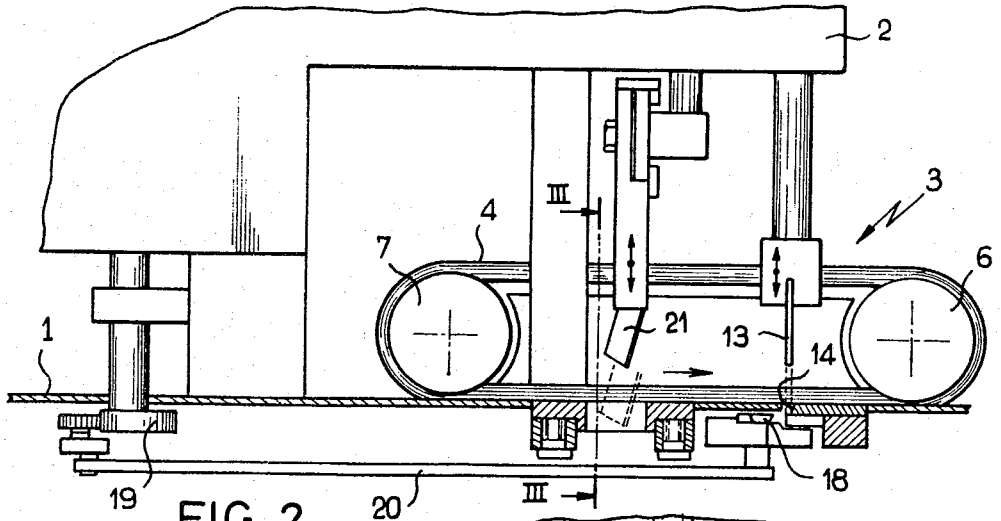
FIG. 2 is a partial view of the machine of FIG. 1.
Figure 4:
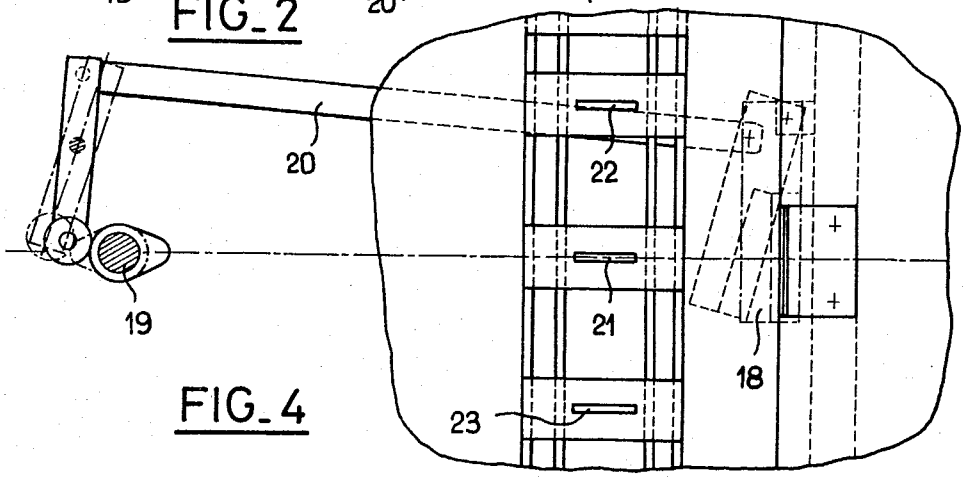
FIG. 4 is a partial plan view of the machine of FIG. 2.

This cutting tool 18 is a knife with reciprocating or circular movement synchronized with the engaging device 13 for cutting the yarns passing through the opening 14 of the table 1 when the engaging device is above the fabric. In the embodiment shown, the cutting tool is a knife with reciprocating motion controlled via a cam 19 and a transmission 20 (FIGS. 2 and 4).

The engaging device 13 and the cutting tool 18 thus make it possible to obtain a drawn fabric having only yarns perpendicular to the direction of advance, the yarns parallel to the direction of advance having been removed over a width corresponding to the transverse width of the punch 13.

To effect fraying, the machine of the invention comprises a fraying knife 21 disposed above the table 1 and behind the punch 13, with respect to the direction of advance, to cut the yarns of the drawn fabric obtained.

This knife is animated by a reciprocating vertical motion or a circular motion and is adjustable transversely to allow the yarns of the drawn fabric to be cut in a determined direction.

The knife 21 makes it possible to obtain:

(a) a fringe whose width is virtually equal to the width of the punch, in the case of the knife being offset with respect to the axis of the punch 13 by a distance corresponding to a half-width of the punch;

(b) two fringes of equal width when the knife is in the axis of the punch;

(c) two fringes of unequal width when the knife is more or less offset with respect to the axis of the punch.

FIG. 5 shows the knife 21 in position for cutting the weft yarns 17 which will form the or each fringe of the fabric.

As shown in FIG. 4, it is possible to provide one or two complementary knives 22 and 23, located outside the belts 4 and driven with the fraying knife 21 to obtain one or two frayed bands to make decorative trimmings.

Figure 6:
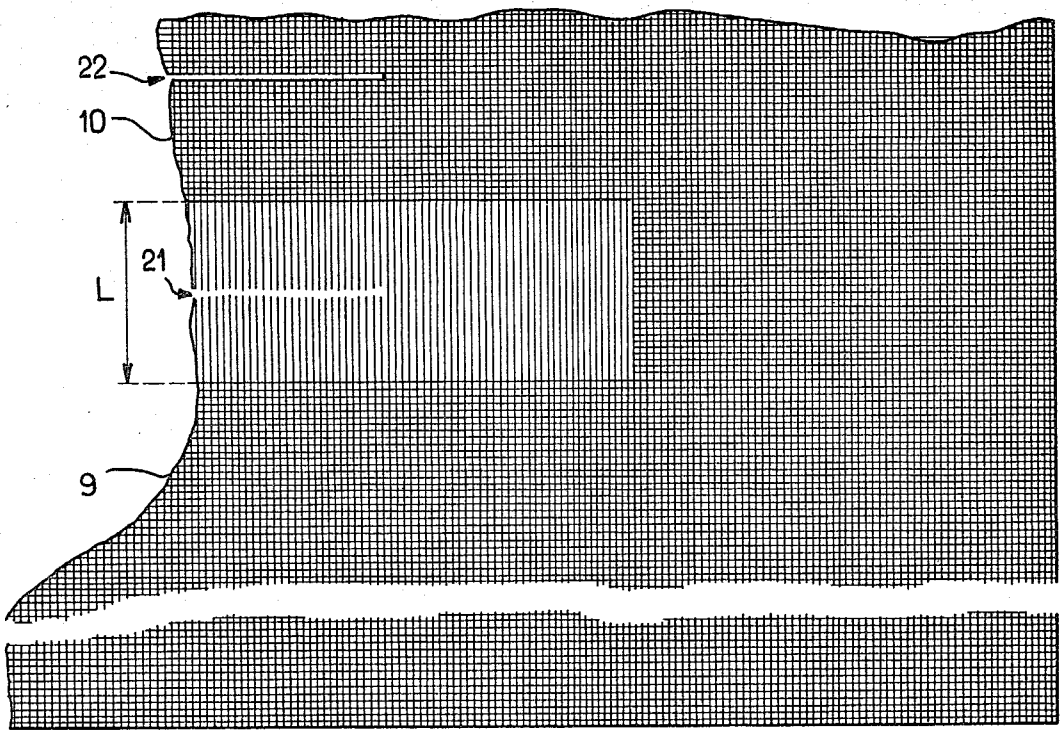
FIG. 6 shows a frayed fabric obtained with the machine of FIG. 1.

As shown in FIG. 6, the fabric 15 is frayed over a width (L) corresponding to the width of the punch 13. The fabric is then cut out by the knife 21 and by knife 22 so as to obtain a fringed fabric 9 and a fringed band 10. The knife 21 being in the axis of the punch 13, the fringes of the band 10 and those of the fabric 9 are equal and correspond substantially to half the width (L).

All the reciprocating movements are synchronized with one another and with the advance of the fabric, the speed of advance being variable with respect to the striking rates.

A suction device 24 is provided beneath the table 1, enabling the waste to be recovered and holding the fabric applied against the table 1, by depression.

In the case of fabric of large dimensions, the machine may comprise lateral conveyor belts to ensure advance thereof.

The machine according to the invention is therefore useful in the textile and clothing industries.

What we claim is:

1. A machine for fraying woven fabrics, said machine comprising a table adapted to receive the fabric, said table including an elongated opening; a drive device adapted to advance the fabric over the table; a movable V-shaped punch disposed perpendicularly with respect to the direction of advance; punch driving means for driving the punch with reciprocating vertical movement so that the punch passes the yarns of the fabric which are parallel to the direction of advance through the opening in the table; a movable cutting tool disposed beneath the table for cutting the yarns having passed through said opening; cutting tool driving means synchronized with the punch driving means in order that the cutting tool cuts the yarns passing through the opening in the table when the punch is above the fabric, so as to obtain a drawn fabric with an area having only yarns perpendicular to the direction of advance; and a movable fraying knife disposed above the table and behind the punch with respect to the direction of advance to cut the perpendicular yarns of the drawn fabric and thereby fray the fabric.

2. The machine of claim 1, wherein the drive device comprises two parallel belts adapted to apply the fabric against two parallel notches provided on the top of the table to ensure tension to the fabric and the movable punch is located between the two belts.

3. The machine of claim 1, wherein the cutting tool is a knife with a reciprocating movement.

4. The machine of claim 1, wherein the fraying knife is a knife movable relative to the table and adjustable transversely with respect to the direction of fabric advance to enable a fringe of predetermined width to be obtained.

5. The machine of claim 4, comprising at least one complementary knife driven with the fraying knife to obtain frayed bands to make decorative trimmings.

6. The machine of claim 1, comprising a suction device placed beneath the table and serving on the one hand to recover the waste and on the other hand to maintain the fabric applied against the table.

* * * * *